US008113451B2

(12) United States Patent
Matlin et al.

(10) Patent No.: US 8,113,451 B2
(45) Date of Patent: Feb. 14, 2012

(54) SHREDDER THICKNESS WITH ANTI-JITTER FEATURE

(75) Inventors: Tai Hoon K. Matlin, Round Lake Beach, IL (US); Michael Dale Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 12/816,903

(22) Filed: Jun. 16, 2010

(65) Prior Publication Data

US 2010/0252664 A1 Oct. 7, 2010

Related U.S. Application Data

(62) Division of application No. 11/867,260, filed on Oct. 4, 2007, now Pat. No. 7,954,737.

(51) Int. Cl.
*B02C 4/32* (2006.01)
*B02C 7/14* (2006.01)

(52) U.S. Cl. ..... 241/36; 241/100; 241/236

(58) Field of Classification Search ..... 241/35, 241/36, 100, 236
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,580 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |

(Continued)

FOREIGN PATENT DOCUMENTS

DE 3313232 10/1984

(Continued)

OTHER PUBLICATIONS

ACCO Rexel, Mainstream 1050/2150/2250/3150/3250 and 3350, 115V Machines Illustrated Parts Lists and Services Instructions, Mar. 25, 2002, Issue No. 4.

(Continued)

*Primary Examiner* — Bena Miller
(74) *Attorney, Agent, or Firm* — Pillsbury Winthrop Shaw Pittman LLP

(57) ABSTRACT

A shredder includes a housing having a throat for receiving at least one article to be shredded, and a shredder mechanism received in the housing and including an electrically powered motor and cutter elements. The shredder also includes a detector that is configured to detect a thickness of the at least one article being received by the throat, and a controller that is configured to operate the motor to drive the cutter elements to shred the at least one article and to set a flutter threshold higher than the predetermined maximum thickness threshold, if the detected thickness is less than a predetermined maximum thickness threshold. The controller is also configured to thereafter continuously detect the thickness of the at least one article being inserted into a throat of the shredder; and to perform a predetermined operation responsive to the thickness detector detecting that the thickness of the at least one article is greater than the flutter threshold.

12 Claims, 9 Drawing Sheets

U.S. PATENT DOCUMENTS

| | | | | |
|---|---|---|---|---|
| 4,497,478 | A | | 2/1985 | Reschenhofer |
| 4,683,381 | A | | 7/1987 | Dufoug |
| 4,707,704 | A | | 11/1987 | Allen |
| 4,757,949 | A | | 7/1988 | Horton |
| 4,814,632 | A | | 3/1989 | Glaeser |
| 4,842,205 | A | | 6/1989 | Araki |
| 4,889,291 | A | | 12/1989 | Goldhammer et al. |
| 4,890,797 | A | | 1/1990 | Fujii et al. |
| 4,914,721 | A | | 4/1990 | Glaeser |
| 5,017,972 | A | | 5/1991 | Daughton |
| 5,081,406 | A | | 1/1992 | Hughes et al. |
| 5,139,205 | A | | 8/1992 | Gallagher et al. |
| 5,166,679 | A | | 11/1992 | Vranish et al. |
| 5,167,374 | A | | 12/1992 | Strohmeyer |
| 5,186,398 | A | | 2/1993 | Vigneau, Jr. |
| 5,198,777 | A | | 3/1993 | Masuda et al. |
| 5,342,033 | A | | 8/1994 | Iwata |
| 5,345,138 | A | | 9/1994 | Mukaidono et al. |
| 5,353,468 | A | | 10/1994 | Yap |
| 5,379,950 | A | * | 1/1995 | Kuster ..... 241/30 |
| 5,397,890 | A | | 3/1995 | Schueler et al. |
| 5,409,171 | A | | 4/1995 | Stangenberg et al. |
| 5,415,355 | A | | 5/1995 | Gollwitzer |
| 5,429,313 | A | | 7/1995 | Schwelling |
| 5,453,644 | A | | 9/1995 | Yap |
| 5,494,229 | A | | 2/1996 | Rokos |
| 5,539,322 | A | | 7/1996 | Zoughi et al. |
| 5,662,280 | A | | 9/1997 | Nishio et al. |
| 5,743,521 | A | | 4/1998 | Munakata et al. |
| 5,772,129 | A | | 6/1998 | Nishio et al. |
| 5,775,605 | A | | 7/1998 | Tsai |
| 5,823,529 | A | | 10/1998 | Mandel |
| 5,850,342 | A | | 12/1998 | Nakamura et al. |
| 5,871,162 | A | | 2/1999 | Rajewski |
| 5,924,637 | A | | 7/1999 | Niederholtmeyer |
| D412,716 | S | | 8/1999 | Kroger |
| 5,942,975 | A | | 8/1999 | Sorenson |
| D414,198 | S | | 9/1999 | Iwata |
| 5,988,542 | A | | 11/1999 | Henreckson |
| 6,065,696 | A | | 5/2000 | Tsai |
| D426,805 | S | | 6/2000 | Iwata |
| 6,079,645 | A | | 6/2000 | Henreckson et al. |
| 6,116,528 | A | | 9/2000 | Schwelling |
| 6,141,883 | A | | 11/2000 | Mitchell et al. |
| 6,265,682 | B1 | | 7/2001 | Lee |
| 6,376,939 | B1 | | 4/2002 | Suzuki et al. |
| 6,418,004 | B1 | | 7/2002 | Mather et al. |
| 6,550,701 | B1 | | 4/2003 | Chang |
| 6,561,444 | B1 | | 5/2003 | Yokomine et al. |
| 6,601,787 | B1 | | 8/2003 | Langenecker |
| 6,655,943 | B1 | | 12/2003 | Peterson |
| 6,666,959 | B2 | | 12/2003 | Uzoh et al. |
| 6,676,460 | B1 | | 1/2004 | Motsenbocker |
| 6,698,640 | B2 | | 3/2004 | Hakozaki |
| 6,724,324 | B1 | | 4/2004 | Lambert |
| 6,802,465 | B1 | | 10/2004 | Norcott et al. |
| 6,979,813 | B2 | | 12/2005 | Avril |
| 6,983,903 | B2 | | 1/2006 | Chang |
| 6,997,408 | B2 | | 2/2006 | Watano |
| 7,025,293 | B2 | | 4/2006 | Matlin et al. |
| 7,040,559 | B2 | | 5/2006 | Matlin |
| 7,166,561 | B2 | | 1/2007 | Allen |
| 7,213,780 | B2 | | 5/2007 | Chen |
| 7,311,276 | B2 | | 12/2007 | Matlin et al. |
| 7,520,452 | B2 | | 4/2009 | Watano et al. |
| 7,624,938 | B2 | | 12/2009 | Aries et al. |
| 7,631,822 | B2 | | 12/2009 | Matlin et al. |
| 7,631,823 | B2 | | 12/2009 | Matlin et al. |
| 7,631,824 | B2 | | 12/2009 | Matlin et al. |
| 7,635,102 | B2 | | 12/2009 | Matlin et al. |
| 7,661,614 | B2 | | 2/2010 | Matlin et al. |
| 7,663,769 | B2 | | 2/2010 | Hayashihara et al. |
| 7,712,689 | B2 | | 5/2010 | Matlin et al. |
| 2003/0042342 | A1 | | 3/2003 | Kroger et al. |
| 2004/0008122 | A1 | | 1/2004 | Michael |
| 2004/0069883 | A1 | | 4/2004 | Watanabe et al. |
| 2004/0159198 | A1 | | 8/2004 | Peot et al. |
| 2004/0194594 | A1 | | 10/2004 | Dils et al. |
| 2004/0226800 | A1 | | 11/2004 | Pierga |
| 2005/0150986 | A1 | | 7/2005 | Castronovo |
| 2006/0016919 | A1 | | 1/2006 | Castronovo |
| 2006/0054725 | A1 | | 3/2006 | Matlin |
| 2006/0091247 | A1 | | 5/2006 | Matlin |
| 2006/0243631 | A1 | | 11/2006 | Duke |
| 2007/0007373 | A1 | | 1/2007 | Matlin |
| 2007/0025239 | A1 | | 2/2007 | Jain et al. |
| 2007/0063082 | A1 | | 3/2007 | Coleman |
| 2007/0080252 | A1 | | 4/2007 | Pierce |
| 2007/0087942 | A1 | | 4/2007 | Allen |
| 2007/0164135 | A1 | | 7/2007 | Zhong |
| 2007/0164138 | A1 | | 7/2007 | Allen |
| 2007/0215728 | A1 | | 9/2007 | Priester |
| 2007/0221767 | A1 | | 9/2007 | Matlin et al. |
| 2007/0246582 | A1 | | 10/2007 | Aries et al. |
| 2008/0093487 | A1 | | 4/2008 | Lee |
| 2008/0231261 | A1 | | 9/2008 | Dengler et al. |
| 2009/0025239 | A1 | | 1/2009 | Pan |
| 2009/0032629 | A1 | | 2/2009 | Aries et al. |
| 2009/0090797 | A1 | | 4/2009 | Matlin et al. |
| 2010/0051731 | A1 | | 3/2010 | Matlin et al. |
| 2010/0084496 | A1 | | 4/2010 | Matlin et al. |
| 2010/0102153 | A1 | | 4/2010 | Matlin et al. |
| 2010/0134805 | A1 | | 6/2010 | Pan |
| 2010/0170967 | A1 | | 7/2010 | Jensen et al. |
| 2010/0170969 | A1 | | 7/2010 | Jensen et al. |
| 2010/0176227 | A1 | | 7/2010 | Davis et al. |
| 2010/0181398 | A1 | | 7/2010 | Davis et al. |
| 2010/0213296 | A1 | | 8/2010 | Sued et al. |
| 2010/0213297 | A1 | | 8/2010 | Sued et al. |
| 2010/0213300 | A1 | | 8/2010 | Matlin et al. |
| 2010/0243774 | A1 | | 9/2010 | Hu et al. |
| 2010/0252661 | A1 | | 10/2010 | Matlin et al. |
| 2010/0252664 | A1 | | 10/2010 | Matlin et al. |
| 2010/0270404 | A1 | | 10/2010 | Chen |
| 2010/0282879 | A1 | | 11/2010 | Chen |
| 2010/0288861 | A1 | | 11/2010 | Cai et al. |
| 2010/0320297 | A1 | | 12/2010 | Matlin et al. |
| 2010/0320299 | A1 | | 12/2010 | Matlin et al. |

FOREIGN PATENT DOCUMENTS

| | | | |
|---|---|---|---|
| DE | 8619856.4 | | 10/1988 |
| DE | 4121330 | | 1/1993 |
| DE | 4207292 | | 1/1993 |
| DE | 4237861 | | 5/1994 |
| DE | 4437348 | | 4/1996 |
| DE | 19835093 | | 2/1999 |
| DE | 202004000907 | | 5/2005 |
| DE | 102006036136 | | 1/2008 |
| DE | 202010001577 | U1 | 11/2010 |
| EP | 268244 | | 11/1987 |
| EP | 0392867 | | 10/1990 |
| EP | 562076 | | 9/1992 |
| EP | 524708 | | 1/1997 |
| EP | 0792691 | | 9/1997 |
| EP | 0818241 | | 1/1998 |
| EP | 856945 | | 1/1998 |
| EP | 855221 | | 7/1998 |
| EP | 1177832 | | 2/2002 |
| EP | 1195202 | | 4/2002 |
| EP | 2180290 | | 7/2008 |
| EP | 2022566 | | 2/2009 |
| GB | 1199903 | | 7/1970 |
| GB | 2171029 | | 8/1986 |
| GB | 2209963 | | 6/1989 |
| GB | 2440651 | | 2/2008 |
| GB | 2442942 | | 4/2008 |
| GB | 2451513 | | 2/2009 |
| JP | 52-11691 | | 1/1977 |
| JP | 57-070445 | | 4/1982 |
| JP | 57-070445 | U | 4/1982 |
| JP | 57-76734 | | 5/1982 |
| JP | 58-223448 | | 12/1983 |
| JP | 61-000702 | | 1/1986 |
| JP | 63-173342 | | 11/1988 |
| JP | 2-277560 | | 11/1990 |
| JP | H2-303550 | | 12/1990 |
| JP | 04-157093 | | 5/1992 |

| | | |
|---|---|---|
| JP | 04-0180852 | 6/1992 |
| JP | 5-96198 | 4/1993 |
| JP | H05-092144 | 4/1993 |
| JP | 6-277548 | 10/1994 |
| JP | 7-299377 | 11/1995 |
| JP | 8-108088 | 4/1996 |
| JP | 8-131861 | 5/1996 |
| JP | 08-131962 | 5/1996 |
| JP | 08-164343 | 6/1996 |
| JP | 9-38513 | 2/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 20000346288 | 12/2000 |
| JP | 2002-239405 | 8/2002 |
| JP | 2002239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

ACCO Rexel, Deckside and Office 115V Machines Illustrated Parts Lists and Service Instructions, Aug. 18, 1999.

ACCO Rexel, Deckside and Office 230V Machines Illustrated Parts Lists and Service Instructions, Aug. 1, 2000.

International Preliminary Examination Report for PCT International Patent Application No. PCT/US2008/078458, mailed Apr. 7, 2010.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

TI's Digital Signal Controllers Put Brake on SawStop Table Saw, Feb. 9, 2005, pp. 1-3. (printed from www.embeddedstar.com/press/content/2005/2/embedded17827.html).

Partial International Search Report issued with Invitation to Pay Additional Fees issued in PCT/US2008/078458, Jan. 26, 2009.

Notification of Transmittal of International Search Report, Search Report and Written Opinion of the International Searching Authority for PCT/US2008/078458, mailed Mar. 30, 2009.

* cited by examiner

SHREDDER THICKNESS WITH ANTI-JITTER FEATURE

CROSS REFERENCE TO RELATED APPLICATIONS

This application is a divisional of U.S. patent application Ser. No. 11/867,260, filed Oct. 4, 2007, the entire contents of which is incorporated herein by reference.

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. The shredder typically has a stated capacity, such as the number of sheets of paper (typically of 20 lb. weight) that may be shredded at one time; however, the feed throat of a typical shredder can receive more sheets of paper than the stated capacity. This is typically done to make feeding easier. A common frustration of users of shredders is to feed too many papers into the feed throat, only to have the shredder jam after it has started to shred the papers. To free the shredder of the papers, the user typically reverses the direction of rotation of the cutter elements via a switch until the papers become free. Occasionally, the jamming may be so severe that reversing may not free the paper and the paper must be pulled out manually, which is very difficult with the paper bound between the blades.

The assignee of the present application, Fellowes, Inc., has developed thickness sensing technologies for shredders. By sensing thickness of the articles being fed, the shredder can be stopped (or not started) before a jam occurs. See U.S. Patent Publication Nos. 2006-0219827 A1 and 2006-0054725 A1, and U.S. application Ser. No. 11/385,864, each of which is incorporated by reference herein in their entirety.

A competitive shredder from Rexel also has a thickness sensor that stops the shredder upon sensing article thickness being over a certain threshold. A light is also illuminated to alert the user. Rexel uses the name Mercury Technology to refer to its thickness sensing feature. See www.rexelshredders.co.uk. To the best of applicants knowledge it is believed that this shredder was first disclosed on that website in January or February 2007.

No admission is made as to whether the foregoing thickness sensing technologies constitute prior art.

BRIEF SUMMARY OF THE INVENTION

It is an aspect of the invention to provide a shredder that does not jam as a result of too many papers, or an article that is too thick, being fed into the shredder.

In an embodiment, a shredder is provided. The shredder includes a housing having a throat for receiving at least one article to be shredded, and a shredder mechanism received in the housing. The shredder mechanism includes an electrically powered motor and cutter elements. The shredder mechanism enables the at least one article to be shredded to be fed into the cutter elements. The motor is operable to drive the cutter elements in a shredding direction so that the cutter elements shred the articles fed therein. The shredder is also includes a thickness detector that is configured to detect a thickness of the at least one article to be shredded being received by the throat, and a controller coupled to the motor and the thickness detector. The controller is configured to operate the motor to drive the cutter elements to shred the at least one article, if the detected thickness is less than a predetermined maximum thickness threshold. The controller is also configured to detect with the thickness detector the thickness of the at least one article being inserted into a throat of the shredder during the operation of the motor, and to perform a predetermined operation if the thickness detected during operation of the motor exceeds a flutter threshold, wherein the flutter threshold is higher than the predetermined maximum thickness threshold.

In another embodiment, a shredder is provided. The shredder includes a housing having a throat for receiving at least one article to be shredded, and a shredder mechanism received in the housing. The shredder mechanism includes an electrically powered motor and cutter elements. The shredder mechanism enables the at least one article to be shredded to be fed into the cutter elements. The motor is operable to drive the cutter elements in a shredding direction so that the cutter elements shred the articles fed therein. The shredder also includes a thickness detector that is configured to detect a thickness of the at least one article to be shredded being received by the throat, and a controller coupled to the motor and the thickness detector. The controller is configured to operate the motor to drive the cutter elements to shred the at least one article, if the detected thickness is less than a predetermined maximum thickness threshold. The controller is also being configured to detect a performance characteristic of the motor and to reduce the predetermined maximum thickness threshold based on the detected performance characteristic of the motor.

In another embodiment, a method for operating a shredder is provided. The method uses a shredder comprising a housing having a throat for receiving at least one article to be shredded, a thickness detector for detecting a thickness of the at least one article to be shredded inserted in the throat, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein. The method includes detecting with the thickness detector a thickness of the at least one article to be shredded inserted into the throat. If the detected thickness is less than a predetermined maximum thickness threshold, operating the motor to drive the cutter elements in the shredding direction to shred the at least one article. Thereafter, during the operation of the motor, detecting with the thickness detector the thickness of the at least one article inserted into the throat, and performing a predetermined operation if the detected thickness exceeds a flutter threshold, wherein the flutter threshold is higher than the predetermined maximum thickness threshold.

In an embodiment, a method for operating a shredder is provided. The method uses a shredder comprising a housing having a throat for receiving at least one article to be shredded, a thickness detector for detecting a thickness of the at least one article to be shredded inserted in the throat, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein. The method includes detecting with the thickness detector a thickness of the at least one article to be shredded inserted into the throat. If the detected thickness is less than a predetermined maximum thickness threshold, operating the motor to drive the cutter elements in the shredding direction to shred the at least one article and detecting during operation of the motor a performance characteristic of the motor. The method also includes reducing the predetermined maximum thickness threshold based on the detected performance characteristic of the motor.

Other aspects, features, and advantages of the present invention will become apparent from the following detailed description, the accompanying drawings, and the appended claims.

DETAILED DESCRIPTION OF THE INVENTION

Figure 1:
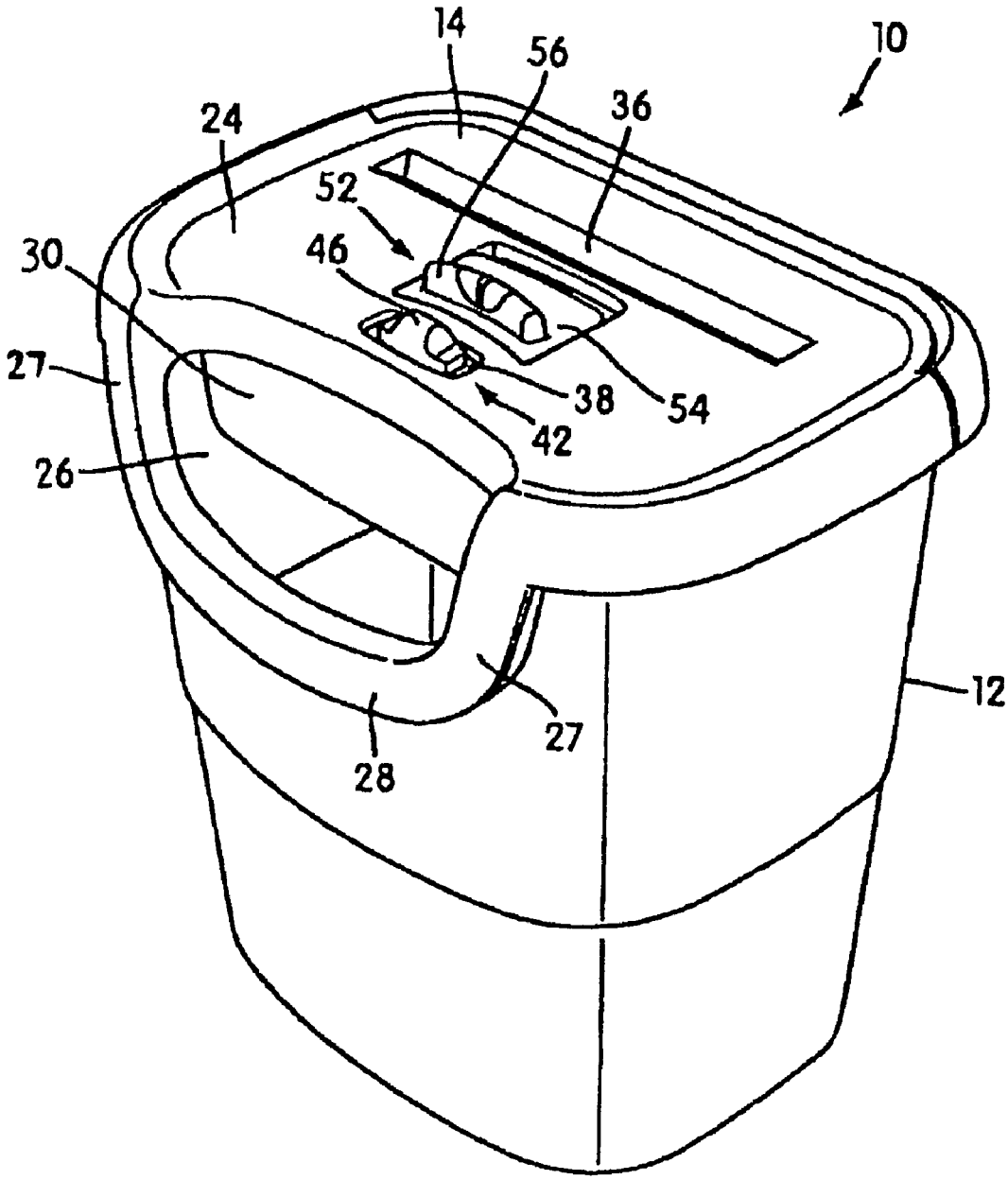
FIG. 1 is a perspective view of a shredder constructed in accordance with an embodiment of the present invention.
Figure 2:
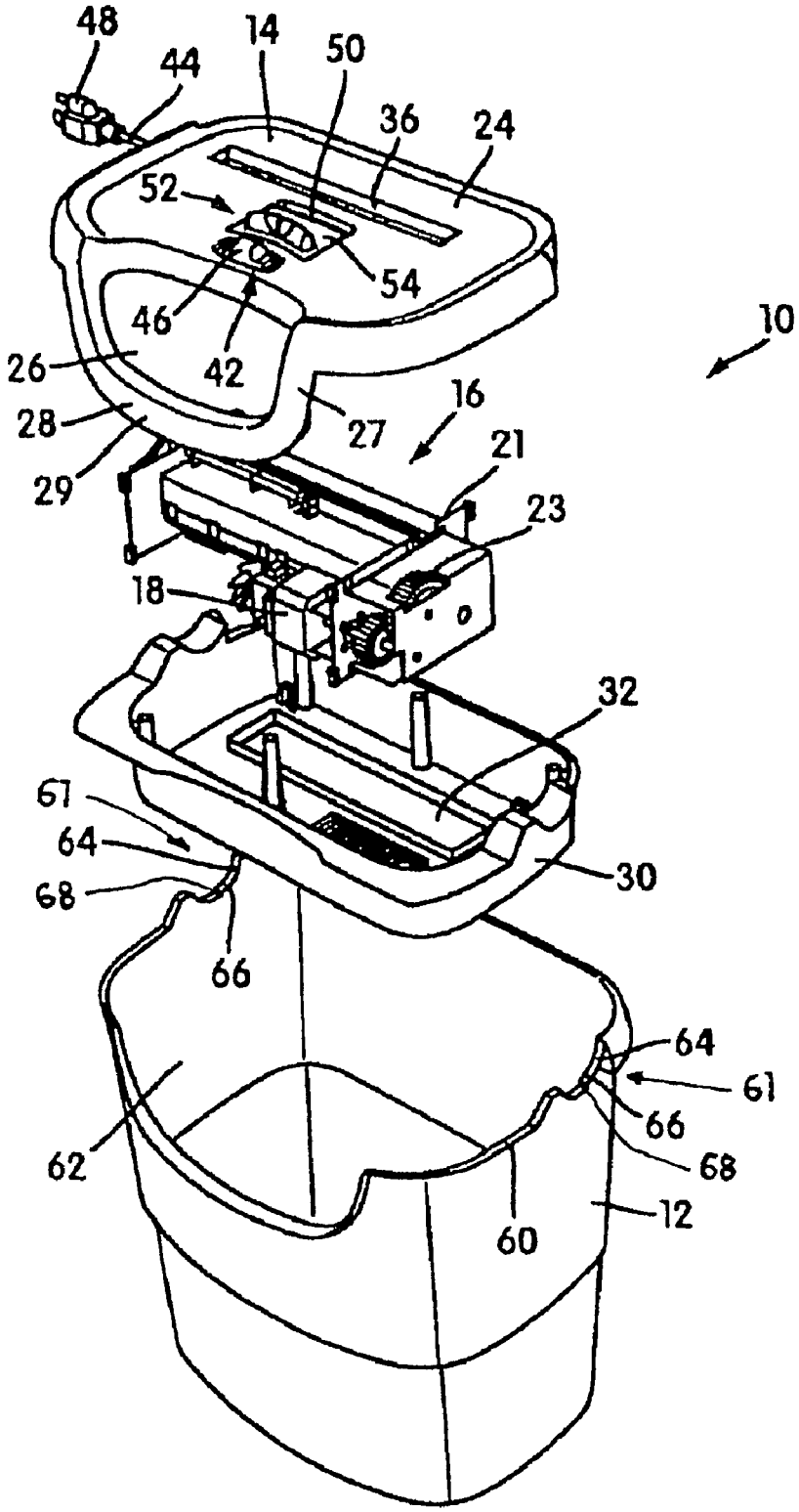
FIG. 2 is an exploded perspective view of the shredder of FIG. 1.

FIGS. 1 and 2 illustrate a shredder constructed in accordance with an embodiment of the present invention. The shredder is generally indicated at 10. In the illustrated embodiment, the shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation. However, the shredder 10 may also be designed so as to sit atop a wide variety of standard waste containers, and the shredder 10 would not be sold with the container. Likewise, the shredder 10 could be part of a large freestanding housing, and a waste container would be enclosed in the housing. An access door would provide for access to and removal of the container. Generally speaking, the shredder 10 may have any suitable construction or configuration and the illustrated embodiment is not intended to be limiting in any way. In addition, the term "shredder" is not intended to be limited to devices that literally "shred" documents and articles, but is instead intended to cover any device that destroys documents and articles in a manner that leaves each document or article illegible and/or useless.

As shown in FIG. 2, in an embodiment, the shredder 10 includes a shredder mechanism 16 that includes an electrically powered motor 18 and a plurality of cutter elements 19. "Shredder mechanism" is a generic structural term to denote a device that destroys articles using at least one cutter element. Such destroying may be done in any particular way. For example, the shredder mechanism may include at least one cutter element that is configured to punch a plurality of holes in the document or article in a manner that destroys the document or article. In the illustrated embodiment, the cutter elements 19 are generally mounted on a pair of parallel rotating shafts 20. The motor 18 operates using electrical power to rotatably drive the shafts and the cutter elements through a conventional transmission 23 so that the cutter elements shred articles fed therein. The shredder mechanism 16 may also include a sub-frame 21 for mounting the shafts, the motor 18, and the transmission 23. The operation and construction of such a shredder mechanism 16 are well known and need not be described herein in detail. Generally, any suitable shredder mechanism 16 known in the art or developed hereafter may be used.

The shredder 10 also includes the shredder housing 14, mentioned above. The shredder housing 14 includes top wall 24 that sits atop the container 12. The top wall 24 is molded from plastic and an opening 26 is located at a front portion thereof. The opening 26 is formed in part by a downwardly depending generally U-shaped member 28. The U-shaped member 28 has a pair of spaced apart connector portions 27 on opposing sides thereof and a hand grip portion 28 extending between the connector portions 27 in spaced apart relation from the housing 14. The opening 26 allows waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 also includes a bottom receptacle 30 having a bottom wall, four side walls and an open top. The shredder mechanism 16 is received therein, and the receptacle 30 is affixed to the underside of the top wall 24 by fasteners. The receptacle 30 has an opening 32 in its bottom wall through which the shredder mechanism 16 discharges shredded articles into the container 12.

The top wall 24 has a generally laterally extending opening, which is often referred to as a throat 36, extending generally parallel and above the cutter elements. The throat 36 enables the articles being shredded to be fed into the cutter elements. As can be appreciated, the throat 36 is relatively narrow, which is desirable for preventing overly thick items, such as large stacks of documents, from being fed into cutter elements, which could lead to jamming. The throat 36 may have any configuration.

The top wall 24 also has a switch recess 38 with an opening therethrough. An on/off switch 42 includes a switch module (not shown) mounted to the top wall 24 underneath the recess 38 by fasteners, and a manually engageable portion 46 that moves laterally within the recess 38. The switch module has a movable element (not shown) that connects to the manually engageable portion 46 through the opening. This enables movement of the manually engageable portion 46 to move the switch module between its states.

In the illustrated embodiment, the switch module connects the motor 18 to the power supply. This connection may be direct or indirect, such as via a controller. Typically, the power supply will be a standard power cord 44 with a plug 48 on its end that plugs into a standard AC outlet. The switch 42 is movable between an on position and an off position by moving the portion 46 laterally within the recess 38. In the on position, contacts in the switch module are closed by movement of the manually engageable portion 46 and the movable element to enable a delivery of electrical power to the motor 18. In the off position, contacts in the switch module are opened to disable the delivery of electric power to the motor 18. Alternatively, the switch may be coupled to a controller, which in turn controls a relay switch, triac etc. for controlling the flow of electricity to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements in a reversing direction for clearing jams. In the illustrated embodiment, in the off position the manually engageable portion 46 and the movable element would be located generally in the center of the recess 38, and the on and reverse positions would be on opposing lateral sides of the off position.

Generally, the construction and operation of the switch 42 for controlling the motor 42 are well known and any construction for such a switch 42 may be used. For example, the switch need not be mechanical and could be of the electro-sensitive type described in U.S. patent application Ser. No. 11/536,145, which is incorporated herein by reference. Likewise, such as switch may be entirely omitted, and the shredder can be started based on insertion of an article to be shredded.

In the illustrated embodiment, the top cover 24 also includes another recess 50 associated with an optional switch lock 52. The switch lock 52 includes a manually engageable portion 54 that is movable by a user's hand and a locking portion (not shown). The manually engageable portion 54 is seated in the recess 50 and the locking portion is located beneath the top wall 24. The locking portion is integrally formed as a plastic piece with the manually engageable portion 54 and extends beneath the top wall 24 via an opening formed in the recess 50.

The switch lock 52 causes the switch 42 to move from either its on position or reverse position to its off position by a camming action as the switch lock 52 is moved from a releasing position to a locking position. In the releasing position, the locking portion is disengaged from the movable element of the switch 42, thus enabling the switch 42 to be moved between its on, off, and reverse positions. In the locking position, the movable element of the switch 42 is restrained in its off position against movement to either its on or reverse position by the locking portion of the switch lock 52.

Preferably, but not necessarily, the manually engageable portion 54 of the switch lock 52 has an upwardly extending projection 56 for facilitating movement of the switch lock 52 between the locking and releasing positions.

One advantage of the switch lock 52 is that, by holding the switch 42 in the off position, to activate the shredder mechanism 16 the switch lock 52 must first be moved to its releasing position, and then the switch 42 is moved to its on or reverse position. This reduces the likelihood of the shredder mechanism 16 being activated unintentionally. Reference may be made to U.S. Pat. No. 7,040,559 B2, which is incorporated herein by reference, for further details of the switch lock 52. This switch lock is an entirely optional feature and may be omitted.

In the illustrated embodiment, the shredder housing 14 is designed specifically for use with the container 12 and it is intended to sell them together. The upper peripheral edge 60 of the container 12 defines an upwardly facing opening 62, and provides a seat 61 on which the shredder 10 is removably mounted. The seat 61 includes a pair of pivot guides 64 provided on opposing lateral sides thereof. The pivot guides 64 include upwardly facing recesses 66 that are defined by walls extending laterally outwardly from the upper edge 60 of the container 12. The walls defining the recesses 66 are molded integrally from plastic with the container 12, but may be provided as separate structures and formed from any other material. At the bottom of each recess 66 is provided a step down or ledge providing a generally vertical engagement surface 68. This step down or ledge is created by two sections of the recesses 66 being provided with different radii. Reference may be made to U.S. Pat. No. 7,025,293, which is incorporated herein by reference, for further details of the pivotal mounting. This pivotal mounting is entirely optional and may be omitted.

Figure 3:
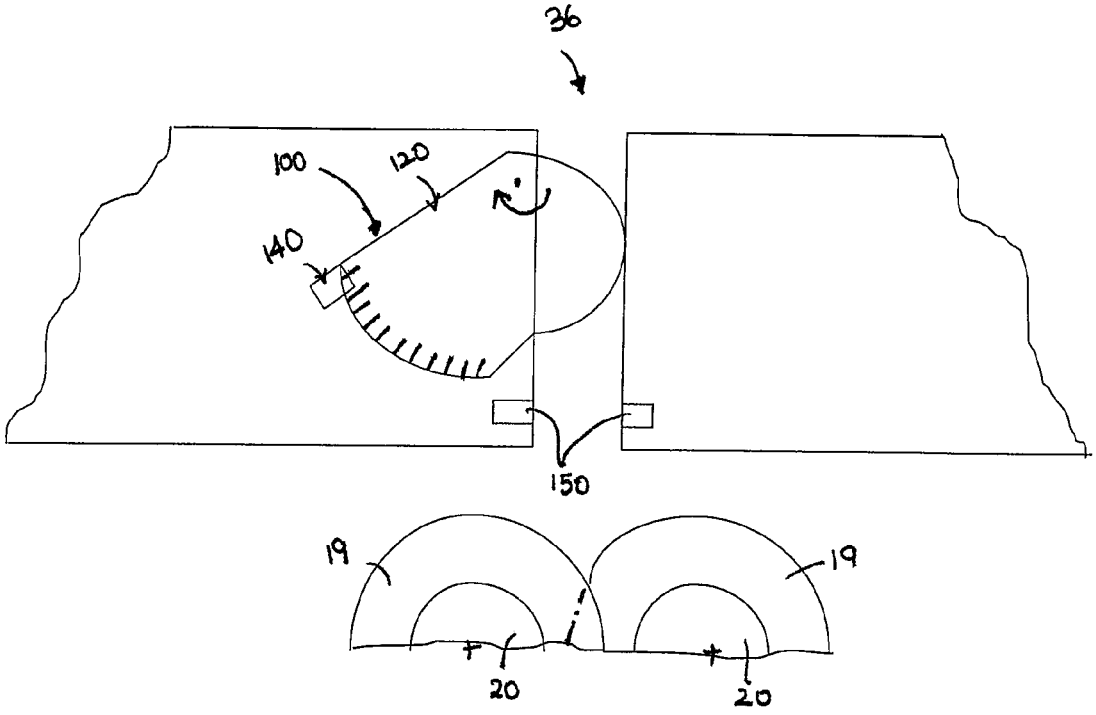
FIG. 3 is a schematic illustration of an embodiment of a detector configured to detect a thickness of a article to be shredded by the shredder.

FIG. 3 shows a detector 100 that may be used to detect the thickness of an article (e.g., a compact disc, credit card, stack of paper, etc.) that is placed in the throat 36 of the shredder 10. As shown in FIG. 3, the detector 100 may include an optical sensor 140. The detector 100 is located above an infrared sensor 150 that detects the presence of an article. Of course, any such sensor may be used. The illustrated embodiment is not intended to be limiting in any way. The sensor 150 provides a signal to the controller 200, which in turn is communicated to the motor 18. When the infrared sensor 150 senses that an article is passing through a lower portion of the throat 36, the controller 200 signals the motor 18 to start turning the shafts 20 and cutter elements 19. Of course, because the detector 100 is also in communication with the controller 200, if the detector 100 detects that the thickness of the article that has entered the throat is too thick for the capacity of the shredder mechanism 16 (i.e., above a predetermined maximum thickness threshold), the shredder mechanism 16 may not operate, even though the infrared sensor 150 has detected the presence of an article. Of course, this particular configuration is not intended to be limiting in any way.

Figure 4:
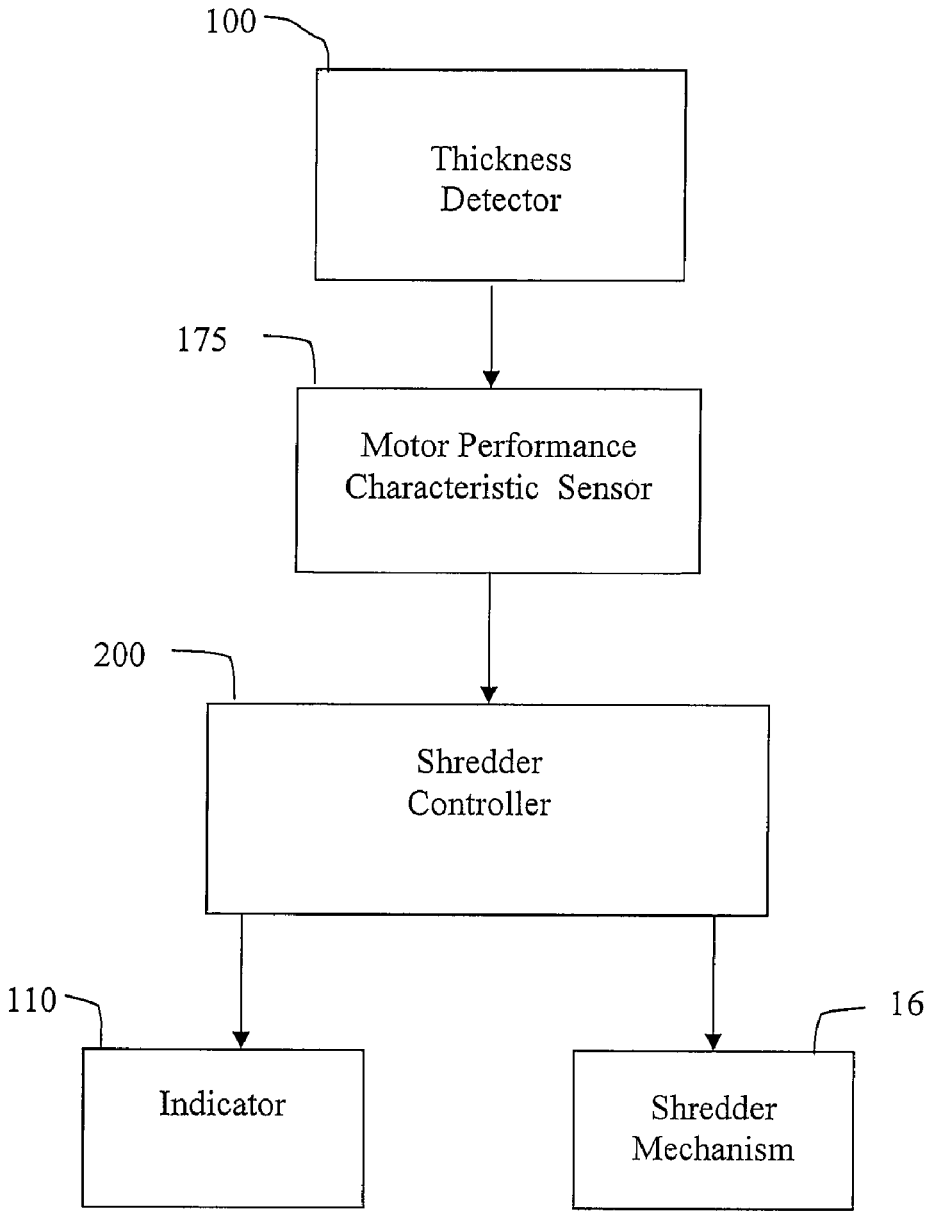
FIG. 4 is a schematic illustration of interaction between a controller and other parts of the shredder.

In an embodiment of the invention, the shredder 10 includes a thickness detector 100 to detect overly thick stacks of documents or other articles that could jam the shredder mechanism 16, and communicate such detection to a controller 200, as shown in FIG. 4. In addition to the thickness detector 100, the shredder 10 also includes a sensor 175 for sensing a performance characteristic of the motor 18. This sensor 175 may be a motor temperature sensor 175 to detect the temperature of the motor and/or a motor current sensor 175 to detect the current drawn by the motor. This sensor 175 communicates such detection to the controller 200, as shown in FIG. 4. The detected performance characteristic is used to adjust the shredder capability. Specifically, during long-term use of the shredder 10, the motor 18 may lose its efficiency and may cause the shredder 10 to shred fewer sheets per pass. Thus, by monitoring the performance characteristic, the predetermined maximum thickness threshold can be reduced to reflect the loss in shredder capability over time.

For example, if the performance characteristic monitored is temperature, an increase in operating temperature of the motor 18 is indicative that its performance is declining. And thus, the controller 200 may be configured to reduce the predetermined maximum thickness threshold based on the increase in temperature. The controller 200 may be configured to sample and store motor temperatures during multiple uses and take an average of those to exclude any abnormal detections (such as if the user inserts something that entirely jams the shredder mechanism). However the detected temperature is derived, it can be compared to a threshold temperature, and if that detected temperature exceeds that threshold, the predetermined maximum thickness threshold can be reduced by a predetermined value (e.g., 5%). For example, the prior predetermined maximum thickness threshold stored in memory can be erased, and the reduced threshold can be stored in the controller memory in its place. This process can be repeated over time as needed to extend the shredder's useful life and reduce the risk of early motor burnout. The same adjustment can be made for the flutter threshold as well (or if the flutter threshold is set as a percentage of detected thickness at the outset of shredding on the predetermined maximum thickness, it need not be reduced, as it will be less of an issue since the predetermined maximum thickness threshold is being reduced). A straightforward comparison may be used for these reductions, as discussed above, or more a complex algorithm or a look-up table may be used.

Likewise, the current flowing through the motor may be the performance characteristic monitored. The current flow is inversely proportional to the motor's resistance, and thus a decrease in current flow means the motor is encountering more resistance. The same process used with the motor temperature would be used with current flow, except that the comparison would look for current flow decreasing below a threshold.

Any other performance characteristic may be monitored, and those noted above are not intended to be limiting. These characteristics may also be used to trigger oiling/maintenance operations, as taught in U.S. Patent Publications No. 2006-0219827, the entirety of which is incorporated herein. And the method of adjusting the predetermined maximum thickness threshold may be delayed until the performance characteristic has been sustained for long enough to indicate the maintenance/oiling has not improved performance. That is, if the performance characteristic has reached its threshold, the controller 200 may initially signal the user via an indicator that maintenance (e.g., oiling) is required. If the controller 200 determines that maintenance has been performed (such as by the user pressing an input to indicate that, or because the controller triggered an automatic maintenance, such as oiling), or if a large enough period of time has passed, and the performance characteristic has still reached the threshold, the predetermined maximum thickness will then be reduced.

Upon detecting that the document(s) inserted exceed the predetermined maximum thickness threshold, the controller 200 may communicate with an indicator 110 that provides a warning signal to the user, such as an audible signal and/or a visual signal. Examples of audible signals include, but are not limited to beeping, buzzing, and/or any other type of signal that will alert the user that the stack of documents or other article that is about to be shredded is above a predetermined maximum thickness threshold and may cause the shredder mechanism 16 to jam. This gives the user the opportunity to reduce the thickness of the stack of documents or reconsider forcing the thick article through the shredder, knowing that any such forcing may jam and/or damage the shredder.

Figure 5:
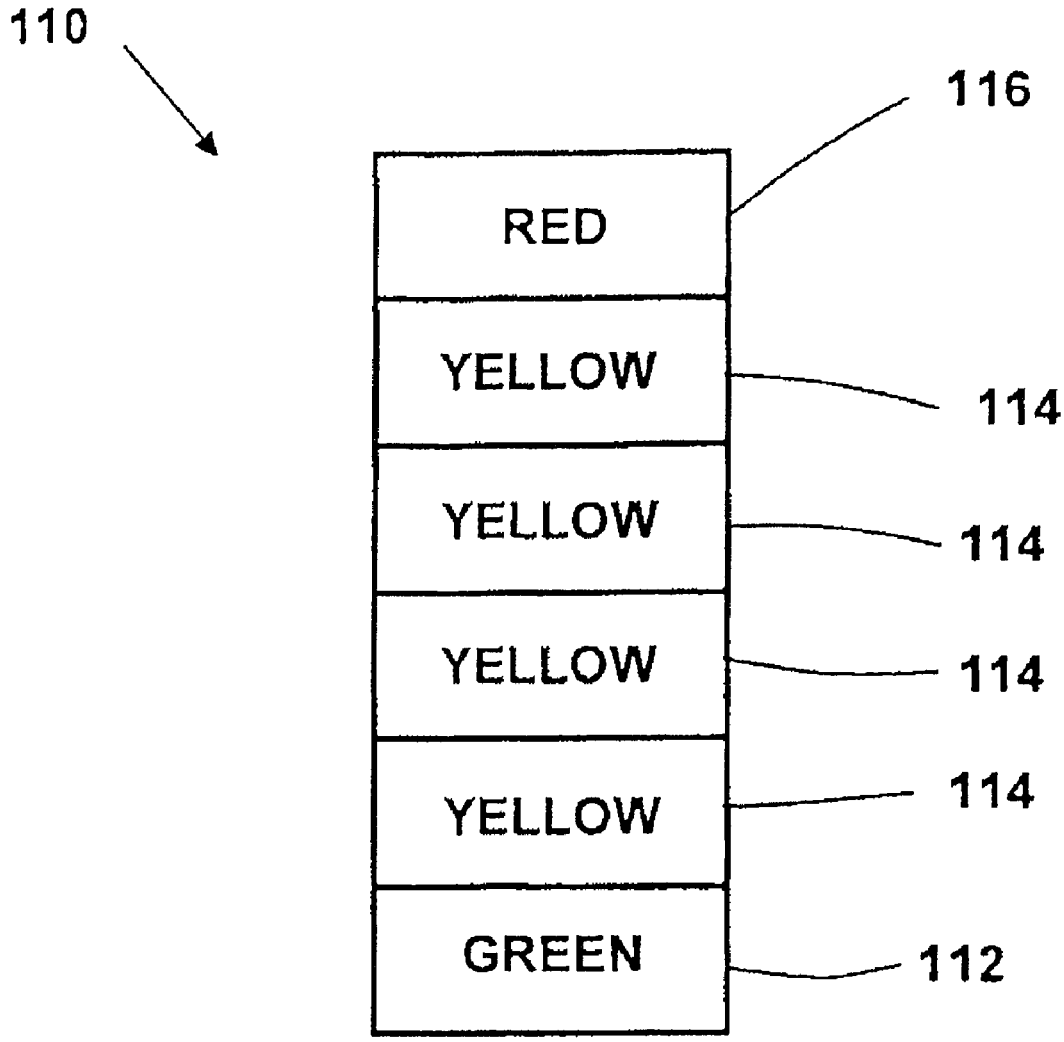
FIG. 5 is a schematic illustration of an embodiment of an indicator located on the shredder.

A visual signal may be provided in the form of a red warning light, which may be emitted from an LED. It is also contemplated that a green light may also be provided to indicate that the shredder 10 is ready to operate. In an embodiment, the indicator 110 is a progressive indication system that includes a series of indicators in the form of lights to indicate the thickness of the stack of documents or other article relative to the capacity of the shredder is provided, as illustrated in FIG. 5. As illustrated, the progressive indication system includes a green light 112, a plurality of yellow lights 114, and a red light 116. The green light 112 indicates that the detected thickness of the item (e.g. a single paper, a stack of papers, a compact disc, a credit card, etc.) that has been placed in the throat 36 of the shredder 10 is below a first predetermined thickness and well within the capacity of the shredder. The yellow lights 114 provide a progressive indication of the thickness of the item. The first yellow light 114, located next to the green light 112, would be triggered when the detected thickness is at or above the first predetermined thickness, but below a second predetermined thickness that triggers the red light 116. If there is more than one yellow light 114, each additional yellow light 114 may correspond to thicknesses at or above a corresponding number of predetermined thicknesses between the first and second predetermined thicknesses. The yellow lights 114 may be used to train the user into getting a feel for how many documents should be shredded at one time. The red light 116 indicates that the detected thickness is at or above the second predetermined thickness, which may be the same as the predetermined maximum thickness threshold, thereby warning the user that this thickness has been reached.

The sequence of lights may be varied and their usage may vary. For example, they may be arranged linearly in a sequence as shown, or in other configurations (e.g. in a partial circle so that they appear like a fuel gauge or speedometer. Also, for example, the yellow light(s) 114 may be lit only for thickness(es) close to (i.e., within 25% of) the predetermined maximum thickness threshold, which triggers the red light 116. This is a useful sequence because of most people's familiarity with traffic lights. Likewise, a plurality of green lights (or any other color) could be used to progressively indicate the detected thickness within a range. Each light would be activated upon the detected thickness being equal to or greater than a corresponding predetermined thickness. A red (or other color) light may be used at the end of the sequence of lights to emphasize that the predetermined maximum thickness threshold has been reached or exceeded (or other ways of getting the user's attention may be used, such as emitting an audible signal, flashing all of the lights in the sequence, etc.). These alert features may be used in lieu of or in conjunction with cutting off power to the shredder mechanism upon detecting that the predetermined maximum thickness threshold has been reached or exceeded.

Similarly, the aforementioned indicators of the progressive indicator system may be in the form of audible signals, rather than visual signals or lights. For example, like the yellow lights described above, audible signals may be used to provide a progressive indication of the thickness of the item. The audible signals may vary by number, frequency, pitch, and/or volume in such a way that provides the user with an indication of how close the detected thickness of the article is to the predetermined maximum thickness threshold. For example, no signal or a single "beep" may be provided when the detected thickness is well below the predetermined maximum thickness threshold, and a series of "beeps" that increase in number (e.g. more "beeps" the closer the detection is to the predetermined maximum thickness threshold) and/or frequency (e.g. less time between beeps the closer the detection is to the predetermined maximum thickness threshold) as the detected thickness approaches the predetermined maximum thickness threshold may be provided. If the detected thickness is equal to or exceeds the predetermined maximum thickness threshold, the series of "beeps" may be continuous, thereby indicating to the user that such a threshold has been met and that the thickness of the article to be shredded should be reduced.

The visual and audible signals may be used together in a single device. Also, other ways of indicating progressive thicknesses of the items inserted in the throat 36 may be used. For example, an LCD screen with a bar graph that increases as the detected thickness increases may be used. Also, a "fuel gauge," i.e., a dial with a pivoting needle moving progressively between zero and a maximum desired thickness, may also be used. As discussed above, with an audible signal, the number or frequency of the intermittent audible noises may increase along with the detected thickness. The invention is not limited to the indicators described herein, and other progressive (i.e., corresponding to multiple predetermined thickness levels) or binary (i.e., corresponding to a single predetermined thickness) indicators may be used.

The aforementioned predetermined thicknesses may be determined as follows. First, because the actual maximum thickness that the shredder mechanism may handle will depend on the material that makes up the item to be shredded, the maximum thickness may correspond to the thickness of the toughest article expected to be inserted into the shredder, such as a compact disc, which is made from polycarbonate. If it is known that the shredder mechanism may only be able to handle one compact disc at a time, the predetermined maximum thickness may be set to the standard thickness of a compact disc (i.e., 1.2 mm). It is estimated that such a thickness would also correspond to about 12 sheets of 20 lb. paper. Second, a margin for error may also be factored in. For example in the example given, the predetermined maximum thickness may be set to a higher thickness, such as to 1.5 mm, which would allow for approximately an additional 3 sheets of paper to be safely inserted into the shredder (but not an additional compact disc). Of course, these examples are not intended to be limiting in any way.

For shredders that include separate throats for receiving sheets of paper and compact discs and/or credit cards, a detector 100 may be provided to each of the throats and configured for different predetermined maximum thicknesses thresholds. For example, the same shredder mechanism may be able to handle one compact disc and 18 sheets of 20 lb. paper. Accordingly, the predetermined maximum thickness threshold associated with the detector associated with the throat that is specifically designed to receive compact discs may be set to about 1.5 mm (0.3 mm above the standard thickness of a compact disc), while the predetermined maximum thickness threshold associated with the detector associated with the throat that is specifically designed to receive sheets of paper may be set to about 1.8 mm. Of course, these examples are not intended to be limiting in any way and are only given to illustrate features of embodiments of the invention. Further details of various thickness sensors and indicators may be found in the assignee's applications incorporated above.

Similarly, a selector switch may optionally be provided on the shredder to allow the user to indicate what type of material is about to be shredded, and, hence the appropriate predetermined maximum thickness threshold for the detector. A given shredder mechanism may be able to handle different maximum thicknesses for different types of materials, and the use of this selector switch allows the controller to use a different predetermined thickness for the material selected. For example, there may be a setting for "paper," "compact discs," and/or "credit cards," as these materials are known to have different cutting characteristics and are popular items to shred for security reasons. Again, based on the capacity of the shredder mechanism, the appropriate predetermined maximum thicknesses threshold may be set based on the known thicknesses of the items to be shredded, whether it is the thickness of a single compact disc or credit card, or the thickness of a predetermined number of sheets of paper of a known weight, such as 20 lb. The selector switch is an optional feature, and the description thereof should not be considered to be limiting in any way.

Returning to FIG. 4, in addition to the indicator 110 discussed above, the detector 100 may also be in communication with the motor 18 that powers the shredder mechanism 16 via the controller 200. Specifically, the controller 200 may control whether power is provided to the motor 18 so that the shafts 20 may rotate the cutter elements 19 and shred the item. This way, if the thickness of the item to be shredded is detected to be greater than the capacity of the shredder mechanism 16, power will not be provided to the shredder mechanism 16, thereby making the shredder 10 temporarily inoperable. This not only protects the motor 18 from overload, it also provides an additional safety feature so that items that should not be placed in the shredder 10 are not able to pass through the shredder mechanism 16, even though they may fit in the throat 36 of the shredder 10.

Figure 6:
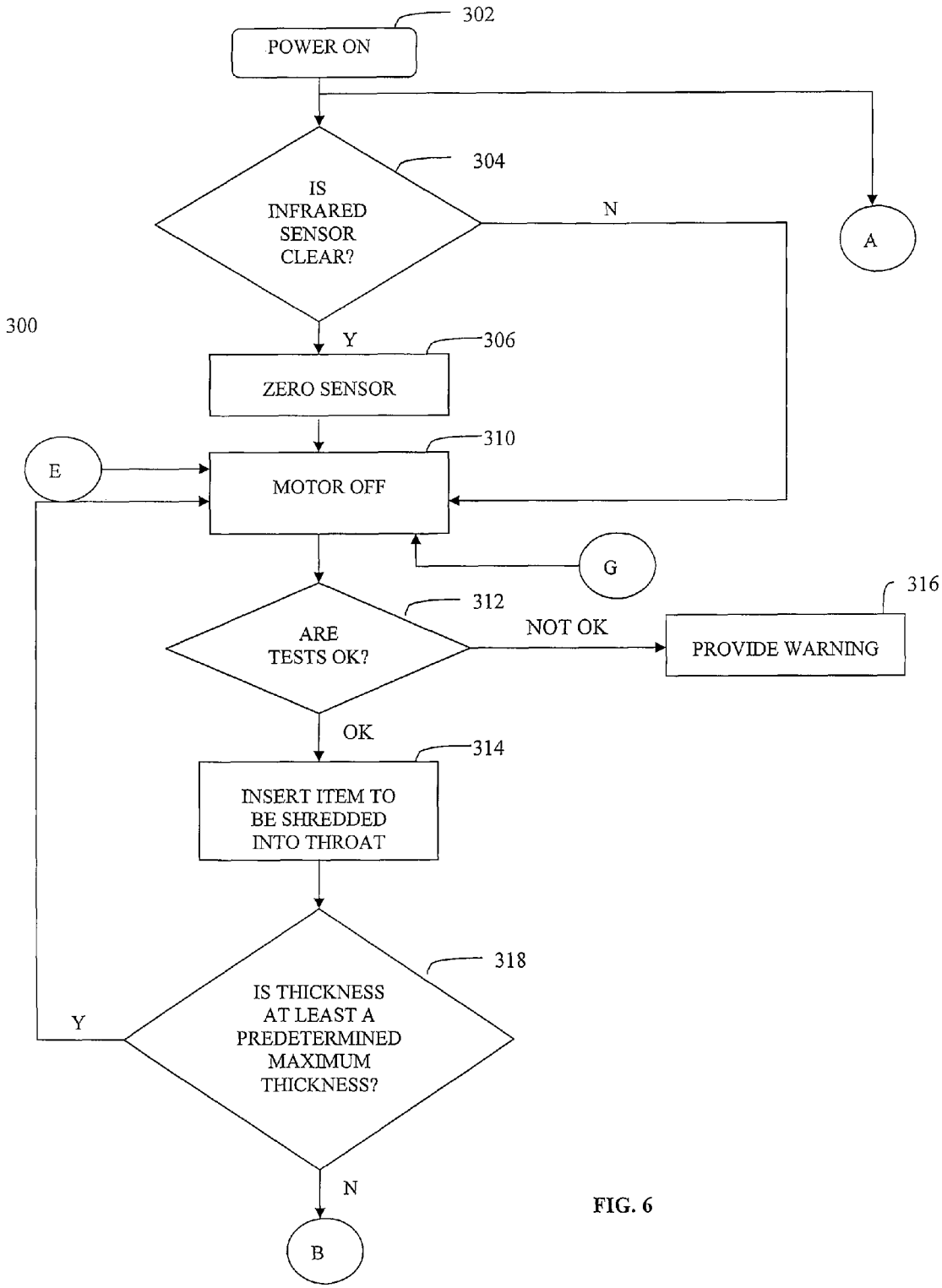
FIG. 6 is a flow diagram of an embodiment of a method for shredding an article.
Figure 7:
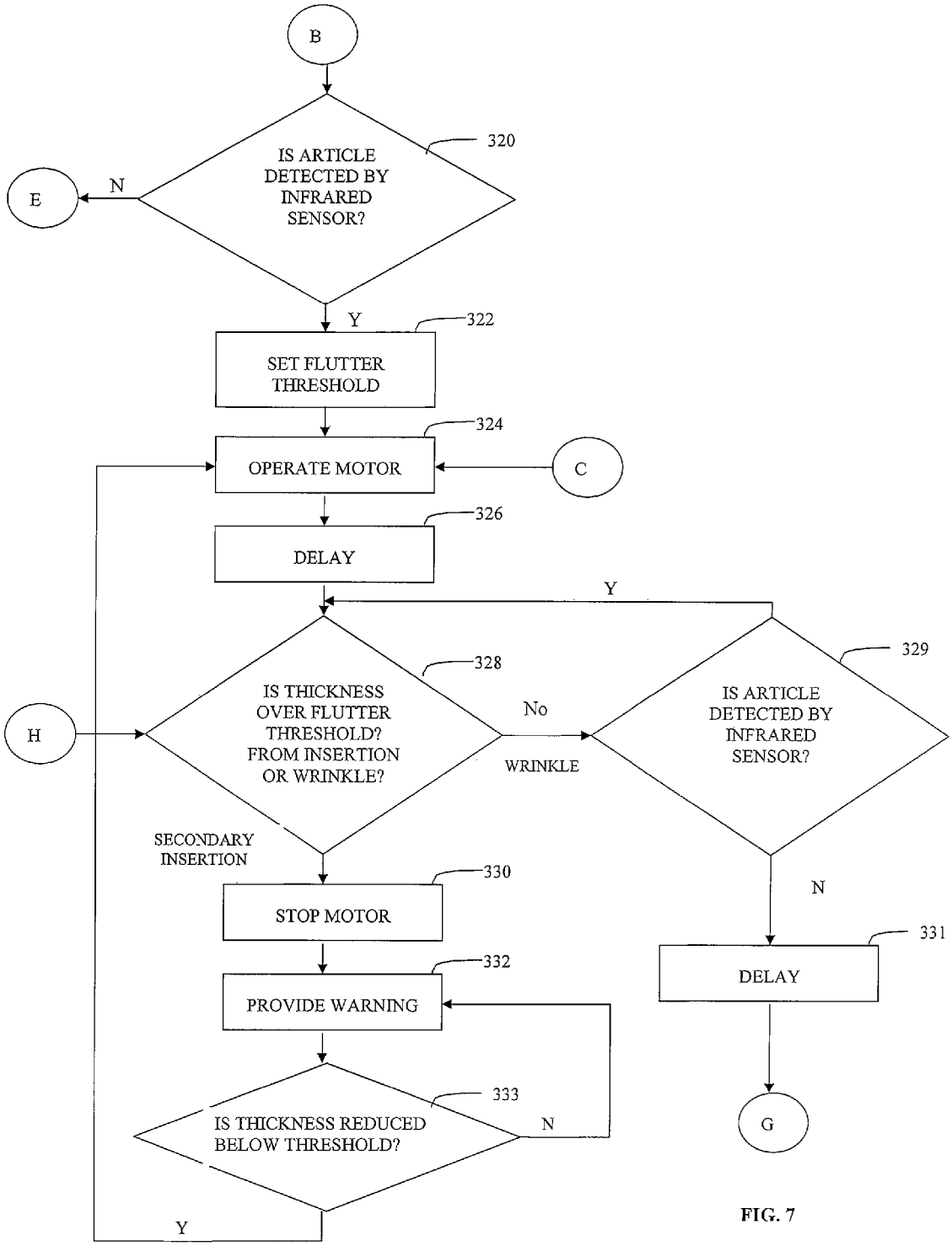
FIG. 7 is a flow diagram of an embodiment of a method for shredding an article.
Figure 8:
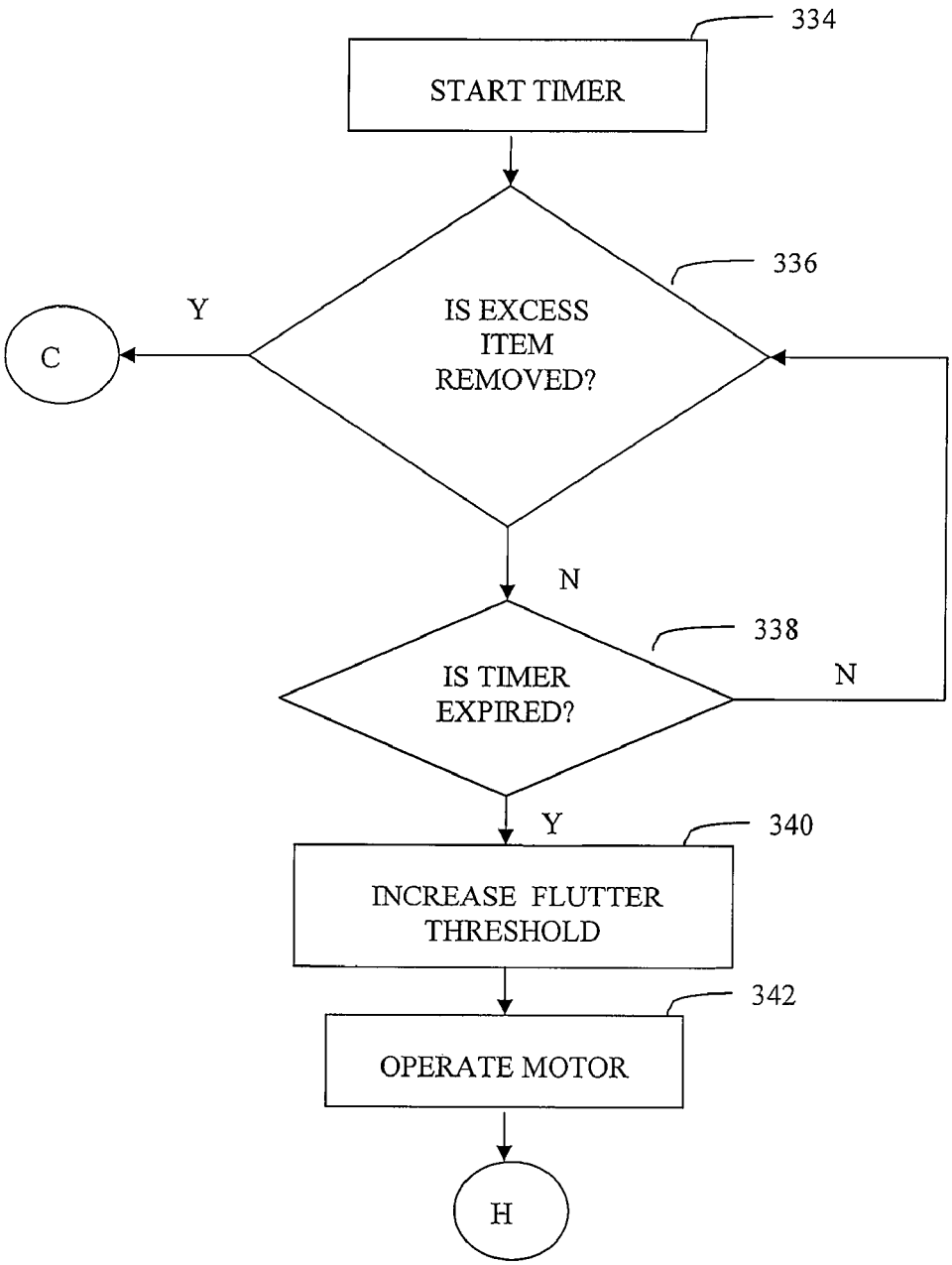
FIG. 8 is a flow diagram of an embodiment of a method for shredding an article.
Figure 9:
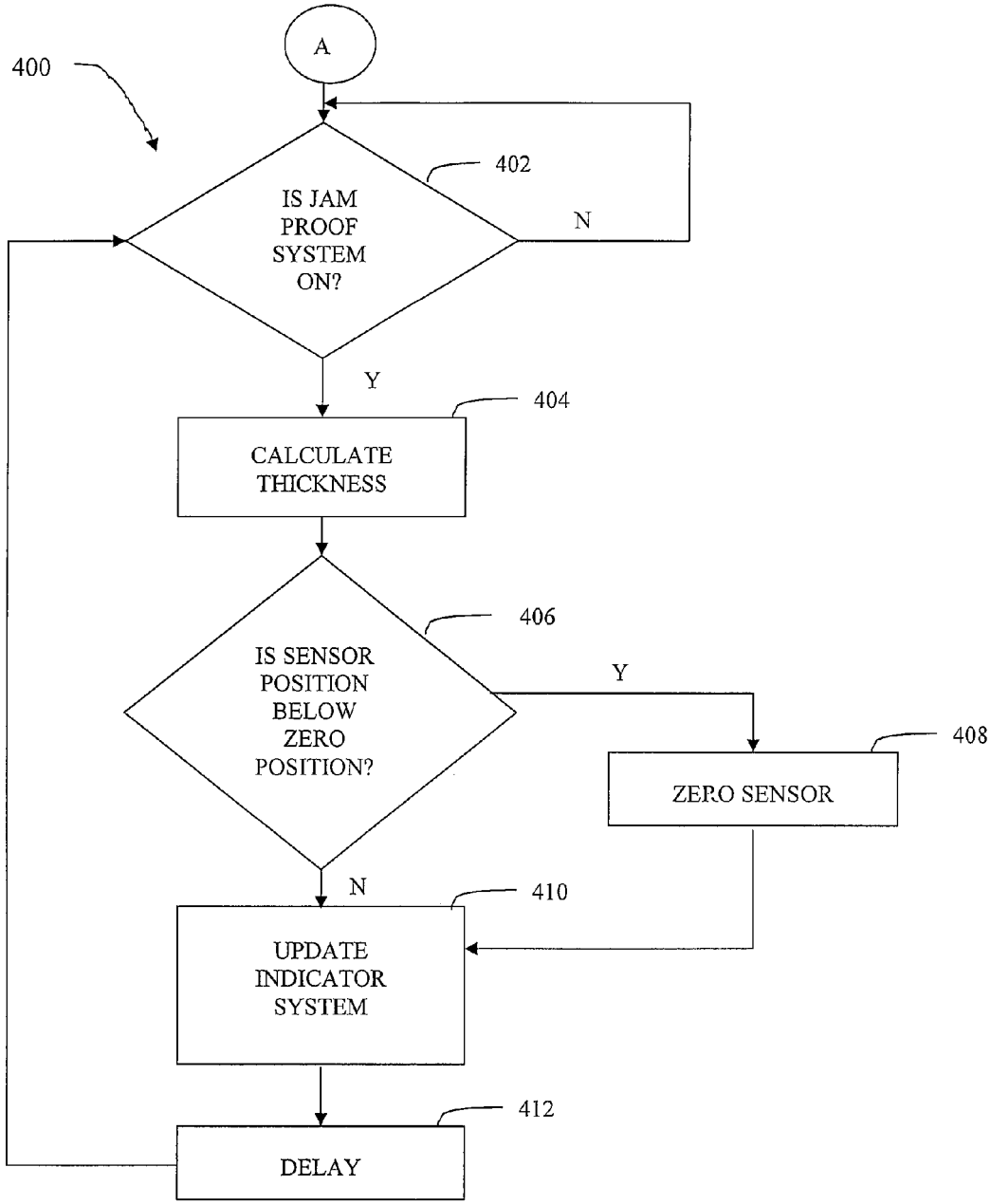
FIG. 9 is a flow diagram of an embodiment of a method for shredding an article.

FIGS. 6-8 illustrate a method 300 for detecting the thickness of an item, e.g. a stack of documents or an article, being fed into the throat 36 of the shredder 10. The method starts at 302 by powering on the shredder 10, which the user may perform by connecting the shredder to a power supply and/or actuating its on/off switch. When the shredder 10 is powered on at 302, the operation of the controller 200 branches out to 304 and to 402. The controller 200 controls the method 300 by proceeding to 304 (FIG. 6) and controls method 400 by proceeding to 402 (FIG. 9). Thus, the controller 200 runs the method 300 and the method 400 concurrently. Such concurrent operation may be parallel, repeatedly alternating series, etc.

At 304, the controller 200 determines whether the infrared sensor 150 is clear of articles. If the controller 200 determines that the infrared sensor 150 is clear of articles, the controller 200 zeroes the sensor at 306. The zero position of the sensor is defined as the position the sensor assumes when the shredder 10 is powered on without an article being inserted into the throat 36 of the shredder 10. The thickness of the article is measured with respect to the zero position of the sensor. Therefore, zeroing the sensor ensures that the thickness of the article is measured accurately.

If the controller 200 determines that the infrared sensor 150 is not clear of articles, the controller 200 proceeds to block 308 and operates the motor 18 in a reverse direction for a short period of time so as to clear articles from the throat 36 of the shredder 10. After operating the motor in reverse, the method 300 may proceed to block 310. Although it would be preferable to zero the sensor at block 306 first, it is possible that a user may insist on leaving an article in the throat even after auto-reversing, expecting to force it to be shredded. To avoid an erroneous zeroing that would be caused by the presence of an article, the zeroing can be skipped, and the last zeroing of the sensor can be used. As an alternative, the reversing in block 308 could run for a set period of time, and then the method 300 could wait to proceed until the infrared sensor 150 has been cleared, thereafter proceeding to zeroing the sensor in block 306.

After zeroing the sensor at 306, the method 300 proceeds to 310 where the motor 18 is turned off and not operating. At 312, the controller 200 performs optional diagnostic tests to detect any faults in the shredder 10. Examples of the tests include, but are not limited to reading current across the motor 18, reading temperature of the motor 18 and checking whether the waste container 12 of the shredder 10 is full. If a fault is detected in the aforementioned tests, the controller 200 may turn on a warning signal to the user, such as an audible signal and/or a visual signal, at 316. Examples of audible signals include, but are not limited to beeping, buzzing, and/or any other type of signal that will alert the user that a fault is detected in the shredder 10. A visual signal may be provided in the form of a red warning light, which may be emitted from an LED. If a fault is not detected in the aforementioned tests, the motor 18 is ready for shredding the at least one article.

At 314, at least one article is inserted into the throat 36 of the shredder 10 by the user and the detector 100 detects the thickness of the at least one article. At 318, the controller 200 determines whether the thickness that has been detected is at least a predetermined maximum thickness threshold. The predetermined maximum thickness threshold may be based on the capacity of the shredder mechanism 16, as discussed above. If the controller 200 determines that the thickness that has been detected is at least the predetermined maximum thickness threshold, the method 300 returns to 310, where the motor stays off and then the controller 200 performs the tests at 312, and so on. As an option, the controller 200 may also actuate an indicator to alert the user that the article is too thick. This is beneficial, as it provides feedback to the user. Any of the indicators discussed above, or any other indicator, may be used for this purpose. If the controller 200 determines that the thickness that has been detected is less than the predetermined maximum thickness threshold, the method 300 proceeds to block 320 (FIG. 7).

If the at least one article is detected by the infrared sensor 150, the method proceeds to 322. If the infrared sensor 150 does not detect the at least one article, the method returns to 310, the controller 200 performs tests at 312, and so on. At 322, the controller 200 sets a flutter threshold, which is higher than the predetermined maximum thickness threshold. During the shredding operation, the trailing portion of the at least one article inserted into the throat 36 of the shredder 10 tends to flutter or wave back and forth. The measured or detected thickness of the fluttering article may be more than the actual thickness of the at least one article, as the thickness detector may be moved by the flutter of the article. This may exceed the predetermined maximum thickness threshold, and unnecessarily cause the controller 200 to shut off the motor 18 assuming that the measured thickness is same as the actual thickness. To prevent the motor 18 from unnecessarily shutting off, a flutter threshold that is higher than the predetermined maximum thickness threshold is set. For example, the flutter threshold may be a fixed percentage or value higher than the predetermined maximum thickness threshold. The flutter threshold provides an additional tolerance to the thickness of the article, thus preventing the motor from shutting off unnecessarily when the trailing portion of the at least one article flutters.

At 324, the controller 200 operates the motor 18 in a forward shredding direction. A delay is incorporated at 326. A severe flutter or bending may develop in the article while the user is inserting the article into the throat 36 of the shredder 10. The delay provides a chance for the at least one article to be completely released by the user and allow the fluttering of at least one article to wane to some extent.

As an option, a change in the thickness sensor readings may be monitored to determine whether the change in the thickness is due to a paper wrinkle or a paper fold (as can happen if the paper is fed into the throat at an angle to the proper feeding direction) or due to an insertion of an additional article in the throat after the shredding has started. This is done by filtering the input and determining whether the change in the thickness reading is rapid and hard as would be the case when an additional article is inserted, or slow and soft as would be the case when a wrinkle is developed over the time during the shred cycle. To differentiate between the two situations, the controller 200 monitors a rate of change in the detected thickness. If the rate is above a rate threshold, this generally indicates that an additional article has been inserted; and likewise if the rate is below a rate threshold, this generally indicates that the thickness change is attributable to the formation of a wrinkle or fold.

At 328, the controller 200 determines whether the thickness that has been detected is at least or exceeds the flutter threshold, and optionally whether it is attributable to the insertion of an additional article or the development of a wrinkle or fold (i.e., by monitoring the rate of thickness change and comparing it to the rate threshold). If the controller 200 determines that the thickness that has been detected is less than the flutter threshold or it exceeds the flutter threshold but the rate of thickness change is below the rate threshold (and most likely a fold or wrinkle), the method 300 proceeds to step 329, where the infrared sensor 150 is again checked for presence of the article. If the article is still present at the infrared sensor 150, the method 300 return to 328. If not, the method 300 proceeds to a delay sufficient to allow the shredding process to be completed (usually 3-5 seconds) at 331, and then to stopping the motor at 310.

If the controller 200 determines that the thickness that has been detected is at least or exceeds the flutter threshold and the rate of thickness change is at or above the rate threshold (likely the result of an additional article being inserted in the throat of the shredder 10), the controller 200 prevents the motor 18 from driving the cutter elements 19 at 330. The controller 200 may turn on a warning signal to the user at 332. For example, the warning signal may include an audible signal and/or a visual signal. Examples of audible signals include, but are not limited to beeping, buzzing, and/or any other type of signal that will alert the user. A visual signal may be provided in the form of a red warning light, which may be emitted from an LED. Any indicator discussed above, or any other suitable indicator, may be used.

At 333, the controller 200 determines whether the thickness that has been detected is reduced to below the flutter threshold. If the controller 200 determines that the thickness that has been detected is less than the flutter threshold (e.g., the user has removed the additional inserted item), the method 300 proceeds to step 324, where the controller 200 operates the motor 18 in a forward shredding direction. If the controller 200 determines that the thickness that has been detected is still not less than the flutter threshold, the method 300 proceeds to step 332, where the controller 200 continues to provide the above mentioned warning signal to the user.

FIG. 8 shows an alternative logic where there is no discrimination based on the rate of thickness changes. The acts in FIG. 8 take the place of block 333 in FIG. 7, and block 328 in FIG. 7 simply determines whether the detected thickness exceeds the flutter threshold. If the detected thickness exceeds the flutter threshold, this alternative logic proceeds through blocks 330 and 332 to block 334 (and if the detected thickness does exceeds the flutter threshold, it proceeds to block 329 as shown in FIG. 7). At step 334, the controller 200 starts a timer, which is set to a preset period of time. The delay provided by the timer gives the user an opportunity to remove any excess paper. At 336, the controller 200 determines whether the detected thickness is at least or exceeds the flutter threshold (e.g., has the user removed the excess paper). When the controller 200 determines that the detected thickness has been reduced below the flutter threshold, the method 300 proceeds back to 324 and restarts the motor 18. If the controller 200 determines that the thickness still is equal to or exceeds the flutter threshold (e.g., by the excess paper not having been removed), then the controller 200 determines whether the timer has expired at 338. If the controller 200 determines that the timer has expired, the method continues to 340. If the controller 200 determines that the timer has not expired, the method returns to 336, and so on until the timer does expire (or the thickness is reduced below the flutter threshold).

After the timer has expired and the excess paper is still not removed, at 340, the controller 200, by assuming that the user wants to force the shredding operation, increases the flutter threshold to higher value than the prior set flutter threshold, thereby allowing the articles to pass through the cutter elements 19. The method 300 then proceeds to 342. At 342, the motor 18 operates to drive the cutter elements 19 so that the cutter elements 19 shred the articles fed into the throat 36 of the shredder 10. Then, the method returns to block 328 where the increased flutter threshold is used for the remainder of the process.

Alternatively, in a variation of the logic in FIG. 8, the method could simply ignore whether the flutter threshold is exceeded, and just proceed to operate the motor 18 to complete the shredding operation. The sensors located on the motor 18 can monitor the motor operating conditions (e.g., the temperature of the motor, the current flowing through the motor, etc) so that the controller 200 can stop the motor if it is overloaded by too many articles being shredded in a conventional manner. The controller 200 will still determine whether infrared is clear of articles. If the controller 200 determines that the infrared is clear of articles, the method 300 returns to 310, and the controller 200 performs the tests at 312, and so on. If the controller 200 determines that the infrared is not clear of articles, the method 300 keeps operating the motor 18, and the controller determines whether the infrared is clear of articles, and so on.

FIG. 9 shows an indicator control method 400 that operates simultaneously to the method 300. This method 400 updates the progressive indicator system and provides the user of the shredder an indication of the detected thickness. The user has an option to turn off the thickness sensing functionality of the shredder. Therefore, at 402, the controller 200 determines whether the jam proof system is turned on. If the controller 200 determines that the jam proof system is turned on, the controller 200 detects the thickness of the article fed into the throat 36 of the shredder 10. If the controller 200 determines that the jam proof system is turned off, the method 400 returns to 402.

At 406, the controller 200 determines whether the position of the sensor is less than the zero position as described above. If the controller 200 determines that the position of the sensor is less than the zero position, the controller 200 zeroes the sensor at 408. After zeroing the sensor, the method 400 proceeds to 410 where the controller 200 updates the progressive indicator system. If the controller 200 determines that the position of the sensor is not less than the zero point, the controller 200 updates the progressive indicator system at 410. The method 400 proceeds to 412 after updating the progressive indicator system based on the detected thickness. A delay is incorporated at 412. The method 400 returns to 402 after the delay, the controller 200 detects the thickness at 404 and so on. The illustrated methods are not intended to be limiting in any way.

For example, to update the progressive indicator system, the controller 200 may cause the red light 116 to illuminate and/or causes an audible signal to sound. If the controller 200 determines that the thickness that has been detected is less than the predetermined maximum thickness threshold, the controller 200 may cause the green light 112 to illuminate. In the embodiment that includes the plurality of yellow lights 114 as part of the indicator 100, if the controller 200 determines that the thickness that has been detected is less than the predetermined maximum thickness threshold, but close to or about the predetermined maximum thickness threshold, the controller 200 may cause one of the yellow lights to illuminate, depending on how close to the predetermined maximum thickness threshold the detected thickness is. For example, the different yellow lights may represent increments of about 0.1 mm so that if the detected thickness is within 0.1 mm of the predetermined maximum thickness threshold, the yellow light 114 that is closest to the red light 116 illuminates, and so on. The user will be warned that the particular thickness is very close to the capacity limit of the shredder 10. Of course, any increment of thickness may be used to cause a particular yellow light to illuminate. The example given should not be considered to be limiting in any way.

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A method for operating a shredder comprising a housing having a throat for receiving at least one article to be shredded, a thickness detector for detecting a thickness of the at least one article to be shredded inserted in the throat, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein; the method comprising:

detecting with the thickness detector a thickness of the at least one article to be shredded inserted into the throat;

if the detected thickness is less than a predetermined maximum thickness threshold, operating the motor to drive the cutter elements in the shredding direction to shred the at least one article;

detecting during operation of the motor a performance characteristic of the motor; and reducing the predetermined maximum thickness threshold based on the detected performance characteristic of the motor.

2. A method according to claim 1, wherein the performance characteristic is selected from the group consisting of: a temperature of the motor during operation, and current flow through the motor.

3. A method according to claim 1, wherein a controller analyzes a plurality of samples of the detected performance characteristic to determine whether the detected performance characteristic has reached a performance characteristic predetermined threshold, and reduces the predetermined maximum thickness threshold responsive to determining that the detected performance characteristic has reached the predetermined performance characteristic threshold.

4. A method for operating a shredder comprising a housing having a throat for receiving at least one article to be shredded, a thickness detector for detecting a thickness of the at least one article to be shredded inserted in the throat, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein; the method comprising:

detecting with the thickness detector a thickness of the at least one article to be shredded inserted into the throat;

if the detected thickness is less than a predetermined maximum thickness threshold, operating the motor to drive the cutter elements in the shredding direction to shred the at least one article;

detecting during operation of the motor a performance characteristic of the motor; and reducing the predetermined maximum thickness threshold based on the detected performance characteristic of the motor, wherein the performance characteristic is selected from the group consisting of: a temperature of the motor during operation, and current flow through the motor, and wherein the predetermined maximum thickness threshold is stored in a memory, and reducing the predetermined maximum thickness threshold is performed by replacing the predetermined maximum thickness threshold in the memory with a reduced predetermined maximum thickness threshold.

5. A method according to claim 4, wherein the reduced predetermined maximum thickness threshold is derived by reducing the predetermined maximum thickness threshold by a predetermined reduction value.

6. A method according to claim 5, wherein the predetermined reduction value is a percentage.

7. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements in a shredding direction so that the cutter elements shred the articles fed therein;

a thickness detector configured to detect a thickness of the at least one article to be shredded being received by the throat; and a controller coupled to the motor and the thickness detector, the controller being configured a) to operate the motor to drive the cutter elements to shred the at least one article, if the detected thickness is less than a predetermined maximum thickness threshold;

b) to detect a performance characteristic of the motor; and c) to reduce the predetermined maximum thickness threshold based on the detected performance characteristic of the motor.

8. A shredder according to claim 7, wherein the performance characteristic is selected from the group consisting of: a temperature of the motor during operation, and current flow through the motor.

9. A shredder according to claim 7, wherein the controller is configured to analyze a plurality of samples of the detected performance characteristic to determine whether the detected performance characteristic has reached a predetermined performance characteristic threshold, and wherein the controller is configured to reduce the predetermined maximum thickness threshold responsive to determining that the detected performance characteristic has reached the predetermined performance characteristic threshold.

10. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements in a shredding direction so that the cutter elements shred the articles fed therein;

a thickness detector configured to detect a thickness of the at least one article to be shredded being received by the throat; and a controller coupled to the motor and the thickness detector, the controller being configured a) to operate the motor to drive the cutter elements to shred the at least one article, if the detected thickness is less than a predetermined maximum thickness threshold;

b) to detect a performance characteristic of the motor ; and c) to reduce the predetermined maximum thickness threshold based on the detected performance characteristic of the motor, wherein the predetermined maximum thickness threshold is stored in a memory, and the predetermined maximum thickness threshold is reduced by replacing the predetermined maximum thickness threshold in the memory with a reduced predetermined maximum thickness threshold.

11. A shredder according to claim 10, wherein the reduced predetermined maximum thickness threshold is derived by reducing the predetermined maximum thickness threshold by a predetermined reduction value.

12. A shredder according to claim 11, wherein the predetermined reduction value is a percentage.

* * * * *